US008069953B2

(12) United States Patent
Sus et al.

(10) Patent No.: US 8,069,953 B2
(45) Date of Patent: Dec. 6, 2011

(54) FOOD ITEM COOKING, ASSEMBLY AND PACKAGING SYSTEM AND METHOD

(75) Inventors: Gerald A. Sus, Frankfort, IL (US); Ed Bridgman, Romeoville, IL (US); David Kirby, Romeoville, IL (US); Thomas Tapper, Schenectady, NY (US)

(73) Assignee: Restaurant Technology, Inc., Oak Brook, IL (US)

( * ) Notice: Subject to any disclaimer, the term of this patent is extended or adjusted under 35 U.S.C. 154(b) by 702 days.

(21) Appl. No.: 12/079,113

(22) Filed: Mar. 25, 2008

(65) Prior Publication Data

US 2009/0241481 A1 Oct. 1, 2009

(51) Int. Cl.
*E04H 3/02* (2006.01)

(52) U.S. Cl. ..... 186/49; 186/41

(58) Field of Classification Search ..... 186/41, 186/49, 50, 57, 58, 59, 60; 198/339.1, 341.08, 198/343.1; 99/355, 443 C
See application file for complete search history.

(56) References Cited

U.S. PATENT DOCUMENTS

| | | | | |
|---|---|---|---|---|
| 2,718,188 | A | 9/1955 | Read et al. | |
| 3,183,856 | A | 5/1965 | Jolly | |
| 3,266,442 | A | 8/1966 | Udall et al. | |
| 3,364,878 | A | 1/1968 | Kobori et al. | |
| 3,377,963 | A | 4/1968 | Anderson et al. | |
| 4,179,985 | A | 12/1979 | Baker et al. | |
| 4,513,656 | A | 4/1985 | Fay | |
| 4,899,666 | A * | 2/1990 | Meier | 104/88.04 |
| 5,101,716 | A | 4/1992 | Cones, Sr. et al. | |
| 5,113,754 | A | 5/1992 | Robinson et al. | |
| 5,132,914 | A | 7/1992 | Cahlander et al. | |
| 5,163,536 | A | 11/1992 | Tuhro et al. | |
| 5,172,328 | A | 12/1992 | Cahlander et al. | |
| 5,279,392 | A * | 1/1994 | Casale et al. | 186/41 |
| 5,365,835 | A | 11/1994 | Naramura | |
| 5,482,139 | A * | 1/1996 | Rivalto | 186/36 |

(Continued)

FOREIGN PATENT DOCUMENTS

WO WO 98/36644 8/1998

(Continued)

OTHER PUBLICATIONS

International Searching Authority, International Search Report and Written Opinion, International Application No. PCT/US09/01507, May 12, 2009.

*Primary Examiner* — Douglas Hess
(74) *Attorney, Agent, or Firm* — Ryndak & Suri LLP

(57) ABSTRACT

A system and method for making a food item are provided. The apparatus includes a food item assembly and packaging station having a first work area for assembling and packaging a food item and a meal order assembly station having a second work area for assembling a meal order that includes a food item packaged on the first work surface. A conveyor is positioned beneath the first work area and extends from a position proximate to the first area to a position proximate to the second work area. A conveyor access opening is proximate to the first work area to provide worker access to the conveyor to permit manual placement of a food item assembled and packaged at the first work area onto the conveyor for conveying the packaged food item beneath the first work area to the location proximate the meal order assembly station.

17 Claims, 6 Drawing Sheets

U.S. PATENT DOCUMENTS 5,493,958 A 2/1996 Naramura
5,528,983 A 6/1996 Carter
5,540,943 A 7/1996 Naramura
5,546,848 A 8/1996 Naramura
5,562,183 A 10/1996 Naramura
5,573,082 A * 11/1996 Conlan et al. ..... 186/44
5,590,586 A 1/1997 Ulfig et al.
5,979,604 A * 11/1999 Pinna et al. ..... 186/39
6,119,587 A 9/2000 Ewald et al.
6,209,447 B1 4/2001 Ewald et al.
6,260,694 B1 7/2001 Sasahara
6,427,806 B1 * 8/2002 Tanaka ..... 186/49
6,607,766 B2 8/2003 Ewald et al.
6,675,950 B1 * 1/2004 Collon ..... 198/465.2
6,914,582 B2 * 7/2005 Tanaka ..... 345/1.1
6,930,296 B2 8/2005 Chen
7,067,769 B2 6/2006 Sands et al.
7,478,749 B2 * 1/2009 Clothier et al. ..... 235/383
2004/0005391 A1 1/2004 Shin
2004/0208961 A1 10/2004 Reckert et al.
2005/0256774 A1 11/2005 Clothier et al.
2007/0253647 A1 11/2007 Sus et al.
2008/0060715 A1 3/2008 Sus et al.

FOREIGN PATENT DOCUMENTS

WO WO 03/107284 A1 12/2003

* cited by examiner

FOOD ITEM COOKING, ASSEMBLY AND PACKAGING SYSTEM AND METHOD

FIELD OF THE INVENTION

This invention relates to a food item cooking, assembly and packaging system, method and kitchen particularly suited for a quick-service restaurant.

BACKGROUND OF THE INVENTION

In a typical quick service restaurant, meals ordered by customers include various food items. Typically, restaurant workers prepare and package these food items at various and relatively diverse areas within the kitchen. Additionally, the components of a food item order and the equipment, supplies and packaging used to prepare, assemble, and package a food item may also be diversely located requiring a worker to travel about the restaurant to accomplish the task of preparing a food item. For example, food items may include buns that need to be conditioned or toasted, sandwich fillings, such as hamburger and sausage patties, chicken and fish filets, and fried and folded eggs, for example, that need to be cooked and thereafter assembled in a sandwich, packaging for the food items such as suitable wrappers, bags or other containers. Crew members or workers are required to travel to various locations within the restaurant to obtain the components that are to be included in the assembled and packaged food item, which may be, for example, a hamburger sandwich. Once the food components are obtained and the food item is assembled and packaged, the packaged food item is then typically manually transported by a human worker walking to one or more meal order assembly areas where the packaged food items are then assembled as part of a meal order including the packaged food item and other items such as drinks. Over the course of the day workers move numerous times between various locations in the store such as to and from cooking food component, assembly, packaging and meal order assembly locations. Worker movements can create bottlenecks at certain locations of the kitchen, and the paths the workers travel may crisscross paths traveled by other workers. This is especially true in the generally limited confines of a quick service restaurant, and also is a particular problem during peak order periods wherein numerous orders must be filled at a rapid pace. Moreover, typical kitchen layouts are an inefficient use of labor adding to the cost of operations.

A need exists for a kitchen system, layout and method of making or assembling food items and packaging them that increases labor efficiencies for food item assembly and packaging, particularly for a quick-service restaurant.

A need exists for a more labor efficient kitchen layout, particularly for a quick-service restaurant.

A need exists to reduce bottlenecks and path crossing of workers that assemble and package food items, particularly in a quick-service restaurant.

SUMMARY OF THE INVENTION

In accordance with the present invention a system and kitchen layout for making an assembled food item is provided. As used herein, the term "system" means an arrangement of things. The system includes a food item assembly and packaging station having a first work area for assembling a food item and packaging an assembled food item and a meal order assembly station that is located remote from the food item assembly and packaging station. The apparatus includes a second work area for assembling a meal order that includes at least one packaged food item packaged at the first work area. A conveyor is positioned to extend from a location proximate the first work area to a location proximate the second work area for conveying a packaged food item from a location proximate the first work area to a location proximate the second work area toward the meal order assembly station. A conveyor access proximate to the first work area provides worker access to the conveyor to permit the assembled and packaged food item at the first work area to be manually deposited at the conveyor access opening onto the conveyor for conveying the packaged food item beneath the first work area to the location proximate the meal order assembly station. Typically, the conveyor is located below the first and second work areas, although the conveyor can be located in whole or in part above, below, at the same level as or otherwise with respect to the first and second work areas.

In accordance with the invention, the apparatus and kitchen may further include at least one food cooking or food heating device proximate to the first work area for cooking food items. The cooking device can be of any suitable type, including, for example, grills (which may be clamshell grills), toasters, fryers, egg cooking devices, conventional and microwave ovens and any other type of cooking or food warming device.

In accordance with another aspect of the invention the first work area includes a first work surface and the conveyor access comprises an opening in the first work area.

In accordance with still another aspect of the invention the first work area has a first side and a second side, each side providing a worker access to the first work area. The conveyor access opening is positioned to be readily accessible to a worker positioned adjacent either of the first and second sides of the first work area.

In accordance with a further aspect of the invention the system includes a secondary work station that is positioned proximate to the food item assembly and packaging station. The secondary work station is adapted for assembling and packaging food items of a different type than those packaged at the food item assembly and packaging station.

In accordance with an additional aspect of the invention the system includes a secondary work station positioned proximate to the food item assembly and packaging station. The secondary work station has a second work surface for assembling and packaging food items and the conveyor access opening is an opening in the second work area.

In accordance with still another aspect of the invention the system includes at least one storage surface at the food item assembly and packaging station for storage of packaging for packaging a food item at the first work area.

In accordance with another aspect of the invention the system includes at least one cooked food storage device proximate to the first work area for staging a cooked food item filling that is included in a food item assembled at the first work area.

In accordance with another aspect of the invention the system includes at least one bun conditioning device positioned proximate to the first work surface for conditioning a bun included in a food item assembled at the first work surface. The bun conditioning device may steam a bun, toast a bun, or both steam and toast a bun.

In accordance with another aspect of the invention the system includes a plurality of secondary work stations each having at least one work area at which assembling or packaging a food item takes place.

In accordance with another aspect of the invention, each of the stations is modular and repositionable within the system to allow reconfiguration of the order of the stations within the apparatus.

In accordance with another aspect of the invention a method of assembling and packaging a food item to be included in a meal order is provided. The method includes providing a first work area for manually assembling and packaging food items, providing a second work area for assembling a meal order that includes a food item packaged in the first work area, providing a conveyor for conveying a packaged food item to the second work area, and providing a conveyor access opening proximate to the first work area. The food item is manually assembled and packaged at the first work area and thereafter the packaged and assembled food item is deposited at the conveyor access opening onto the conveyor and thereafter conveyed beneath and along the first work area to the second work area. Thereafter, a packaged food item conveyed from the first work area to the second work area is included in a meal order that is manually assembled at the second work area wherein the meal order includes the conveyed, packaged food item. Typically, the conveyor is located below the first and second work areas, although the conveyor can be located in whole or in part above, below, at the same level as or otherwise with respect to the first and second work areas.

In accordance with another aspect of the invention the method includes providing a supply of packaging proximate to the first work area, providing a supply of cooked food item filling proximate to the first work area, and providing a supply of buns for forming the food item proximate to the first work area. The supply of packaging, cooked food filling and buns are manually accessed during assembling and packaging of a food item at the first work area. A supply of items for assembling a meal order is provided proximate the second work area and is manually accessed to assemble a meal order at the second work area.

The method may include providing at least a third work area for manually assembling and packaging a food item. The third work area is positioned upstream of the first work area, and the third work area includes a conveyor access opening therethrough to provide access to the conveyor.

In accordance with another aspect of the invention the method further includes providing at least third and fourth work areas for manually assembling and packaging a food item. The third work area and fourth work area are positioned upstream of the first work area with a conveyor extending underneath the third work area. A first type of food item is assembled and packaged at the first work area. A second type of food item is assembled and packaged at either of the third or fourth work areas. The second type of food item is conveyed after packaging to the second work area for inclusion of the second type of food item in a meal order assembled at the second work area.

Other advantages and features of the invention will become apparent from the following description and from reference to the drawings.

DETAILED DESCRIPTION

Figure 1:
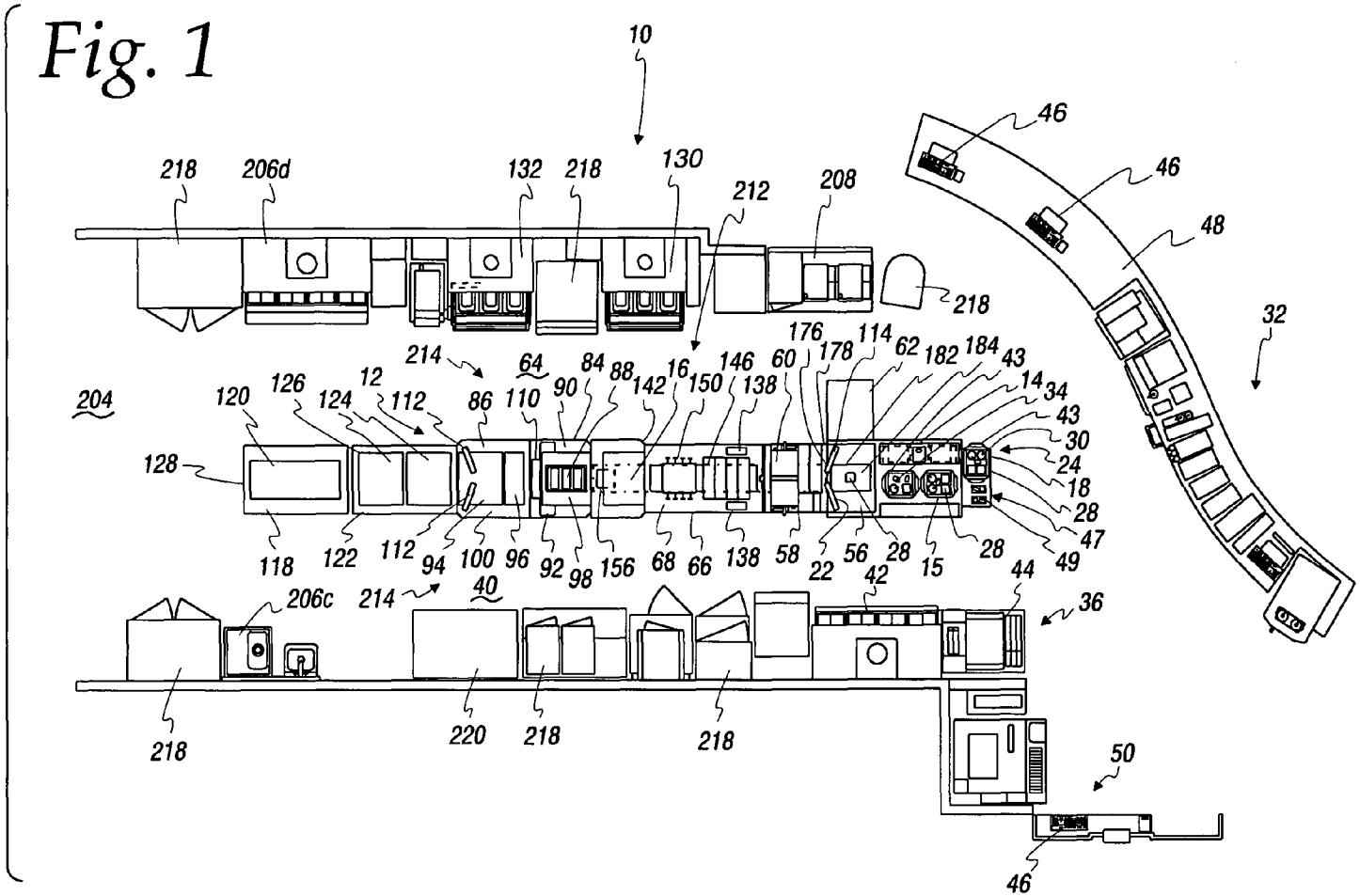
FIG. 1 is a schematic view of the restaurant layout in accordance with the present invention.

While this invention is susceptible of embodiment in many different forms, there are shown in the drawings and described in detail herein, several specific embodiments with the understanding that the present disclosure is to be considered as exemplifications of the principles of the invention and is not intended to limit the invention to the embodiments illustrated.

In a typical prior art quick-service restaurant layout, workers typically are required to walk individually prepared food items to a meal order assembly area where they are included with other items as part of an assembled meal order that is then delivered to a customer. This is not only a relatively inefficient use of labor, but can create traffic bottlenecks in the vicinity of the meal order assembly area, especially in the confines of a quick-service restaurant which generally has relatively limited space. Additional labor inefficiencies arise due to hindrance of worker movement by the crisscrossing paths of workers moving about as they access required items for preparing different types of food items, such as inventory, supplies, food item components, cooked food staging devices and other equipment that is diversely located within the kitchen.

FIG. 1 illustrates an exemplary system and kitchen layout 10 for a quick-service restaurant in accordance with the present invention. The system and kitchen layout 10 is highly efficient since required worker travel distance to prepare a food item and assemble a meal order is substantially reduced. Moreover, interference between workers moving about the kitchen is also substantially reduced. Kitchen layout 10 includes a food item assembly line 12 that is used to prepare food items ordered by restaurant customers. Food items that are prepared, assembled and/or packaged on assembly line 12 are conveyed on an underneath conveyor 16 to a meal order assembly station or module 14 positioned at the downstream end 18 of assembly line 12. Such food items typically include sandwiches of various types, such as hamburger sandwiches, chicken sandwiches, breakfast egg sandwiches, such as Egg McMuffin® sandwiches, and other sandwiches typically served in a quick-service restaurant. Food items conveyed to meal order assembly module 14 typically also include chicken nuggets, Chicken Selects®, breakfast egg orders, hot cakes and the like.

The use of conveyor 16 reduces the distance traveled by a worker since travel back and forth to the meal order assembly station is reduced or eliminated. Worker travel distance may further be reduced by also using conveyor 16 to convey other food items prepared, assembled, and/or packaged in locations of kitchen layout 10 but off-line of assembly line 12. For example, a salad order may be prepared and packaged in a location that is upstream of meal order assembly station 14 and across an aisle along assembly line 12, and thereafter conveyed to the meal order assembly station 14 by conveyor 16. Transporting food items, whether prepared on or off assembly line 12, by means of conveyor 16 also is advantageous in providing a more orderly flow of food items into meal order assembly station 14.

As described later in greater detail, in another aspect of the present invention, worker efficiency is increased by localizing or linking by food item type, the locations for cooking food items, storing cooked food items, and assembling and packaging of food items. Thus, the placement of inventory, supplies, cooking equipment, cooked food storage equipment, packaging supplies, buns, cooked sandwich fillings, condiments and the like that are associated with cooking, staging, assembling and packaging of food items is based on individual food item types. By creating localized kitchen areas within the quick-service restaurant kitchen along or proximate to assembly line 12, worker efficiency is further increased by reducing the distance traveled by workers in the performance of their duties in the quick-service restaurant. Examples of localized kitchen areas may also include a regular menu region where the primary functions of hamburger sandwich, filet of fish sandwiches may take place. Another localized area may be a breakfast food region that is primarily dedicated to the preparation of breakfast food items. Optionally, the main menu and breakfast menu regions may include further localized sections. For example, the breakfast menu region may have subsections for preparing different individual types of breakfast food items, such as a subsection for breakfast sandwiches and a subsection for breakfast egg food items.

Figure 2:
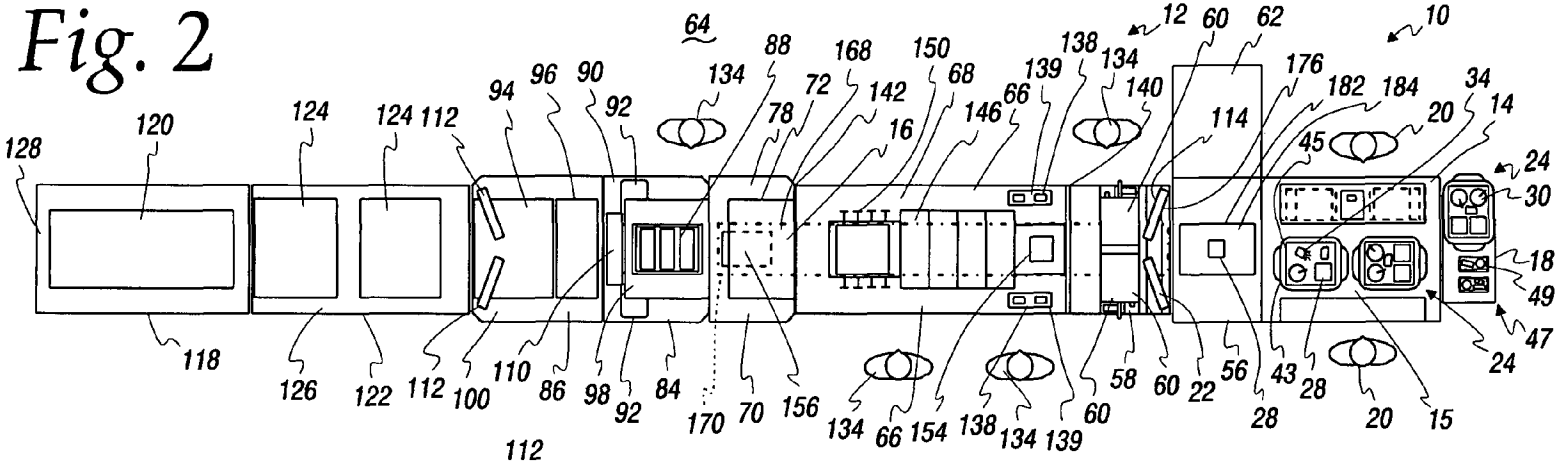
FIG. 2 is a top plan view of the system in accordance present invention.
Figure 3:
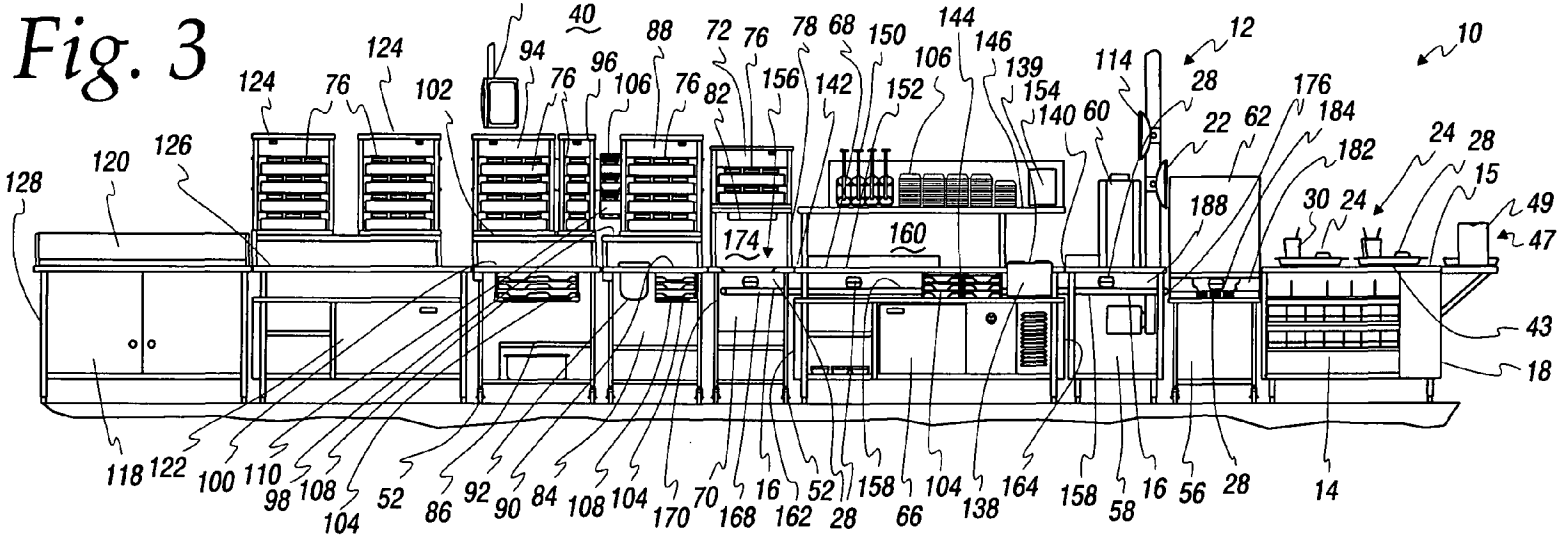
FIG. 3 is a side elevation view of the system shown in FIG. 2.
Figure 4:
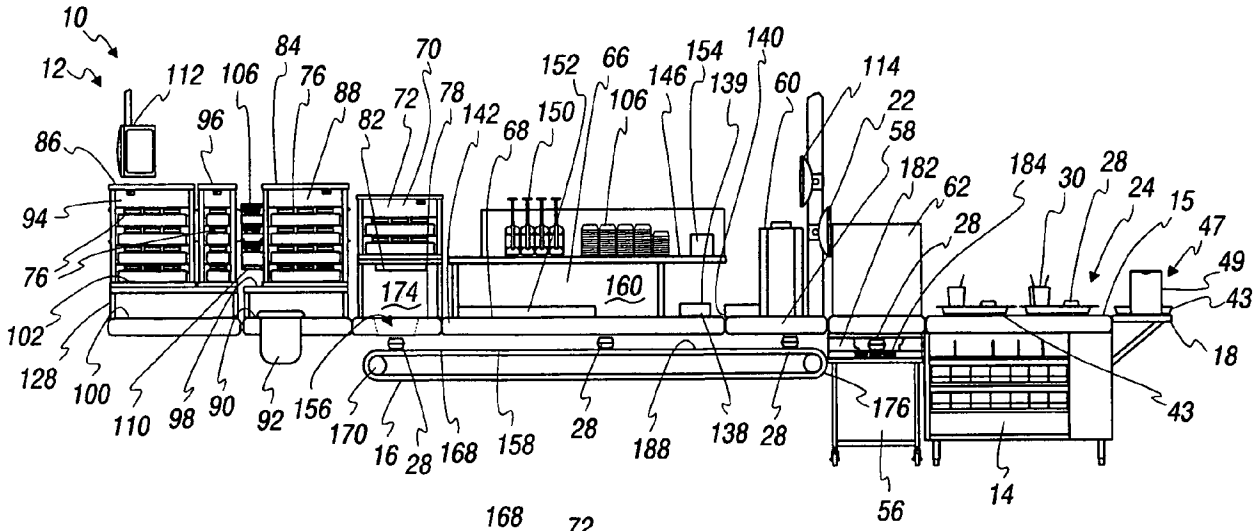
FIG. 4 is a fragmentary schematic side view of the system shown in FIG. 3 illustrating the conveyor positioned underneath the work surface and the location of the food item drop off point.

Returning now to a more detailed description of the functions required for meal order assembly, in FIG. 2 a meal order assembly worker 20 is shown stationed at a work area or surface 15 for meal order assembly station 14. Worker 20 views a list of the contents of each meal order to be assembled. Such listing may be provided on an optional display screen 22 as shown in FIG. 3 that electronically displays specific details of pending meal orders that need to be assembled. An assembled meal order 24 typically includes a packaged food item 28 such as a packaged sandwich that has been assembled upstream on assembly line 12, and generally additional meal items. These additional meal items may include food items that may not typically be suitable for efficient transport on a conveyor, such as drink 30, an order of French fries 34 packaged in an open top container laid on its side, and the like. Drink 30 for meal order 24 can be obtained by meal order assembly worker 20 from a proximately located drink order station 32. Drink order station 32 includes dispensers for various types of drinks such as sodas, iced tea, shakes, coffee, smoothies and the like. An order of French fries 34 is obtained by worker 20 from French fry station 36, that also preferably is located proximate to the meal order assembly station 14, such as across the assembly line aisle 40. French fry station 36 typically includes French fry cooking vats 42, French fry holding bin 44, and packaging (not shown) for individual French fry orders 34.

Meal order assembly station 14 is also preferably positioned proximate to POS registers 46 at customer service counter 48, and POS register 46 at the drive-thru delivery area 50. Thus, by locating meal order assembly station 14 proximate to the meal order delivery areas of counter 48 and drive-thru delivery area 50, labor efficiencies are provided that complement the reduction in labor expenditures that are obtained when assembling and packaging food items on assembly line 12 in accordance with the invention. Typically, meal orders 24 to be consumed in the restaurant are assembled on a tray 43 having a paper mat 45 placed thereon. Drive-thru meal orders 47 typically are packaged in a bag 49. Storage for trays 43, paper mats 45, bags 49 and other such required items is provided at or proximate to meal order assembly station 14.

Food item assembly line 12 preferably is of a modular construction as can best be appreciated by viewing FIGS. 2 and 3. Some or all of the modules may be made mobile by including wheels 52 to allow easy configuration and reconfiguration of the modules of assembly line 12 as required to best meet the needs of a particular quick-service restaurant. The present invention also may be advantageously practiced, however, without a modular construction. For example, assembly line 12 may be constructed as one integral work surface having various sections or work areas located along assembly line 12 at which the work functions conducted at the various modules are performed.

The exemplary configuration shown in FIGS. 2 and 3 illustrates assembly line 12 configured for the efficient assembly of a plurality of different types of food items. Examples of these types of food items include hamburger sandwiches, cooked chicken product filled sandwiches, cooked fish fillet filled sandwiches, and breakfast sandwiches such as Egg McMuffin® sandwiches, and cooked eggs. Assembly line 12 also is adaptable for other types of sandwich and food items where a work area for preparing, assembling and/or packaging the food item is desired. Positioned at downstream end 18 of assembly line 12 is meal order assembly module 14. Adjacent to and upstream from module 14 is a packaged food item staging module 56 for receiving and staging packaged food items 28 conveyed thereto. Packaged food items 28 are held at module 56 until included as part of a specific assembled meal order 24. Packaged food item staging module 56 preferably includes a heating means for maintaining the packaged food items at an elevated temperature. Upstream from packaged food item staging module 56 is a steamer/toaster module 58 that includes a steamer/toaster device 60 for steaming and then toasting bun crowns and heels that are then used to make a sandwich. A supply of buns may be kept in storage cabinets at module 58, or adjacent modules, or held in an optional mobile bun storage rack 62 positioned in aisle 64 or aisle 40 along assembly line 12.

Positioned upstream of module 58 is a food item assembly and packaging module 66 that includes a work area such as preparation surface 68 at which food items are assembled. Typically, preparation surface 68 will be the primary work surface at which the largest number of food items are assembled, such as, for example, a regular menu food item like hamburger sandwiches. Preparation surface 68 at module 66 also provides a location at which condiments are added to sandwiches or other food items assembled there. Sandwiches assembled at module 66 can also be packaged on preparation surface 68, typically by wrapping in a sheet of paper or placing in a closeable carton. Also included at assembly module 66 is conveyor 16 which is positioned underneath and extending along preparation surface 68. As described below in greater detail, conveyor 16 is provided as one means of increasing worker productivity for assembly line 12 by automatically transporting food items assembled and packaged on assembly line 12 to meal order assembly module 14.

Positioned upstream from the food item assembly module 66 are additional or secondary stations or modules 70, 84, and 86, each of which typically includes staging means for staging cooked sandwich fillings at an elevated temperature. Each of secondary modules 70, 84 and 86 typically also include additional work surfaces that provide secondary work areas for preparing and/or packaging food items. Generally, the type of food item that will be prepared on secondary work surfaces of modules 70, 84, and 86 is different than the type of food items that will be prepared at the primary preparation surface 68. This allows workers to simultaneously prepare different types of food items on assembly line 12, with the workers also having proximate access to the different inventory and items associated with a particular type of food item, such as cooked sandwich filling, buns, condiments, sauces, packaging and the like.

As shown in the exemplary configuration of assembly line 12 of FIGS. 2 and 3, secondary module 70 includes a cooked food storage device 72 that is most suitable to stage a type of cooked food item assembled or packaged at a work surface at or proximate to module 70. Cooked food storage device 72, for example, a universal holding cabinet (UHC) is used to stage one or more types of food product to be used as the food item, or a component of a food item, such as a cooked sandwich filling to be placed into a sandwich. Cooked food storage device 72 may be used, for example, to stage cooked hamburger patties or cooked fish fillets. Typically, a plurality of individual cooked food products of the same type is placed in a tray 76 soon after cooking. Tray 76 is then placed in cooked food storage device 72 until a cooked food product such as a cooked sandwich filling is needed to make a sandwich. A cooked food product placed in trays 76 in the cooked food storage device 72 maintains its temperature, moisture and freshness until used as a cooked food sandwich filling. A preferred example of such UHC equipment is disclosed in U.S. Pat, Nos. 6,119,587, 6,209,447 and 6,607,766, the entire disclosures of which are hereby incorporated by reference. Cooked food storage device 72 is supported above a work surface 78 that is included at secondary module 70. Especially at times of high food item order activity, work surface 78 also provides an additional work area upon which food items may be assembled including food item types that generally are assembled at other modules. Secondary module 70 may also include storage drawer 82 for utensils such as tongs used in withdrawing cooked sandwich fillings from food storage trays 76 of cooked food storage device 72. In the exemplary configuration, secondary module 84 and secondary module 86 are positioned upstream from secondary module 70. Secondary module 84 includes a cooked food storage device 88, such as a UHC cabinet for staging cooked food items or cooked sandwich filling in trays 76. Secondary module 84 also includes a work area such as work surface 90. Typically, work surface 90 generally will be used to assemble and package a food item that is taken from cooked food storage device 88 at module 84 or from a cooked food storage device at an adjacent secondary module. Secondary module 84 may additionally include an alternative type of food staging device, such as a hot water holding bath 92. Hot water holding bath 92 is a type of cooked food storage device that is more advantageous than a UHC for storing certain types of cooked foods such as breakfast sausages, for example. An example of such hot water holding bath equipment is disclosed in U.S. patent application Ser. No. 11/413,385 filed Apr. 28, 2006, the entire disclosure of which is hereby incorporated by reference. Secondary module 84 may also include a second work surface 98 above work surface 90.

Secondary module 86 includes additional cooked food storage devices, such as separate cooked food storage devices 94, 96, that typically may be used to store different types of food items, such as different types of cooked food sandwich fillings. Secondary module 86 also includes a lower work surface 100 and an upper work surface 102 for the assembling and packaging of food items. Packaging materials such as paper wrappers 104 and food item cartons 106 associated with food items assembled at module 86, are stored at shelving 108,110 respectively. Shelving 110 may be located at secondary module 84, secondary module 86, or both.

Display screens 112, 114 are provided to electronically display food item orders needed to be assembled and packaged in assembly line 12. When an order is entered at the computerized POS register 46, the particular food item order is caused to appear on display screens 112, 114. Alternatively, the POS computer system may be programmed to selectively distribute food item order information to only one of displays 112, 114. For example, sandwiches or other food items typically assembled at secondary modules 70, 84, 86 may be displayed only on display 112, while for example a food item, such as hamburger sandwiches typically assembled at module 66, may only be displayed at display 114. Also, to prevent a particular food item order from being inadvertently prepared in duplicate, once a particular food item order is assembled (or once assembly is initiated), means may be provided to indicate on displays 112, 114 that the particular food item order has been assembled, or is in the process of being assembled. For example, assembly line 12 may include worker input means to cause displays 112, 114 to indicate that a food item order is or has been assembled as a way to inform other workers that they should work on other food item orders.

Assembly line 12 optionally also may include one or more in-line cooking modules for a food item. For example, a breakfast eggs cooking module 118 includes a cooking device 120 for cooking breakfast eggs, such as scrambled eggs. An optional additional secondary module 122 also may be included with cooked food storage devices 124 and work area 126. Typically, eggs cooked at cooking device 120 will be stored in cooked food storage devices 124 and packaged as a food item at work area 126.

In the exemplary kitchen layout 10, cooking devices such as clamshell grills 130 and 132, are positioned across aisle 64 proximate to assembly line 12 and to secondary modules 70 and 84. Thus, for example, hamburger patties may be grilled at clamshell grill 130 and stored at secondary module 70 in cooked food storage device 72. Chicken sandwich fillings for chicken orders, such as chicken nuggets and Chicken Selects® may be grilled at grill 132 and stored at cooked food storage devices 94 and 96 at secondary module 86. Additional modules for cooking, storage and food item assembly and packaging also may be optionally placed upstream from upstream end 128 of assembly line 12. This additionally would allow expansion of assembly line 12 for purposes such as increasing the output capacity of assembly line 12, or for the assembling and packaging of additional types of food items, including those food items later added to the quick-service restaurant menu. Optionally, if desired, grills 130 and 132 may also be positioned in an in-line configuration along assembly line 12. The same is true for drink station 32, fry station 36 and other such stations.

In order to better appreciate the labor efficiencies provided by assembly line 12 and better understand its operation, a detailed description of food item assembly and packaging at module 66 is provided. Food item assembly and packaging module 66, in one desired preferred mode of operation, is typically primarily dedicated to the assembling of hamburger sandwiches and fish fillet sandwiches. When a hamburger or fish sandwich order appears on display screen 114, the first task of a food item assembly worker 134 is to condition a bun for such sandwich. To do so, a sandwich bun is taken from a supply of buns stored at module 66, or alternatively within mobile bun storage rack 62. In the case of a hamburger sandwich order, the heel and crown of the buns are steamed and toasted in steamer/toaster device 60. Preferably to conserve lateral space along assembly line 12, steamer/toast device 60 has a vertical feed path. In the case of a fish filet sandwich, the bun heel and crown are steamed at one of the steamer devices 138. Preferably, steamer device 138 is positioned adjacent to end 140 of preparation surface 68. Typically, steamer device 138 is operated by manually placing a bun heel and crown onto steamer device 138, and therefore is positioned so as to be conveniently accessed by a worker at preparation surface 68. Steamer device 138 may be recessed within preparation surface 68 so that its operable top side 139 is at, or near, the level of preparation surface 68. Optionally however, steamer devices 138 could alternatively be located at other nearby positions such as at the steamer/toaster module 58 or at end 142 of preparation surface 68. Typically, while the buns are being steamed and toasted, packaging for the sandwich is placed on preparation surface 68. Depending on the size and type of sandwich, such packaging may include a paper wrapper 104 or a carton 106 that are preferably stored at module 66 at shelves 144, 146 respectively. The heel of a steamed or a steamed/toasted bun is placed on, or in the packaging that has been placed on preparation surface 68. Thereafter, a cooked sandwich filling, such as a hamburger patty or cooked fish filet, is removed from one of trays 76 and placed on the bun heel. Based on customary practices and on the information displayed on display screen 114, condiments, sauces and toppings are added to the partially assembled sandwich. For example, ketchup, mustard, sauces and the like may be dispensed from a dispenser 150, and lettuce, sliced tomatoes, relish, onions and the like are taken from individual containers (not shown) positioned in condiment containers 152. The crown of a steamed bun or a steamed/toasted bun is then placed on the sandwich to complete its assembly. The packaging of the sandwich is then finalized by folding wrapper 104 or by closing the sandwich carton 106. A printer 154 is also provided for printing a label such as 'extra ketchup' or 'no salt' that can be affixed to the packaging of a special food item order for easy identification of any special orders by order assembly worker 20.

In order to substantially reduce labor time required to manually transport a food item assembled at food order assembly module 66, conveyor 16 is used to automatically convey the packaged sandwich to meal order assembly module 14. Importantly, conveyor 16 is positioned so as to minimize intrusion into space that is generally considered optimal for worker usage in preparing and packaging food items. Generally, for convenience and efficiency in making sandwiches it is preferred that preparation surface 68 be positioned at a height that is about waist high for a typical food item assembly and packaging worker 134. The work space 160 above preparation surface 68 is considered optimal work space, since it is within convenient and quick reach of worker 134 without requiring worker 134 to bend over, such as to access spaces below preparation surface 68 and work space 160. Therefore, the top of belt 158 of conveyor 16 is preferably located below preparation surface 68. By positioning conveyor 16 below preparation surface 68, the work surface area of preparation surface 68 is not reduced by the presence of conveyor 16. Moreover, the entire work space 160 that is above preparation surface 68 also is free from interference of the presence of conveyor 16. Thus, work space 160 is more advantageously preserved for frequently accessed items, such as cartons 106, condiment containers in condiment container holding bin 152, condiments in dispenser 150, wrappers 104, bun steamer 138, steamer/toaster device 60 and cooked food storage device 72, for example.

Figure 5:
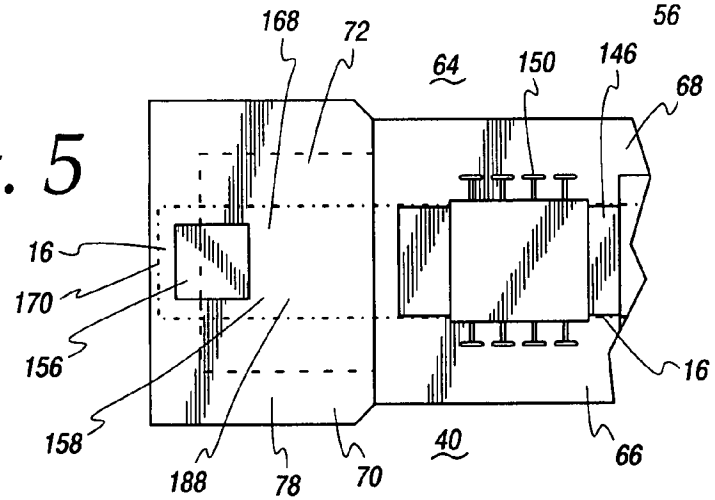
FIG. 5 is a fragmentary top plan view illustrating the conveyor access opening.
Figure 6:
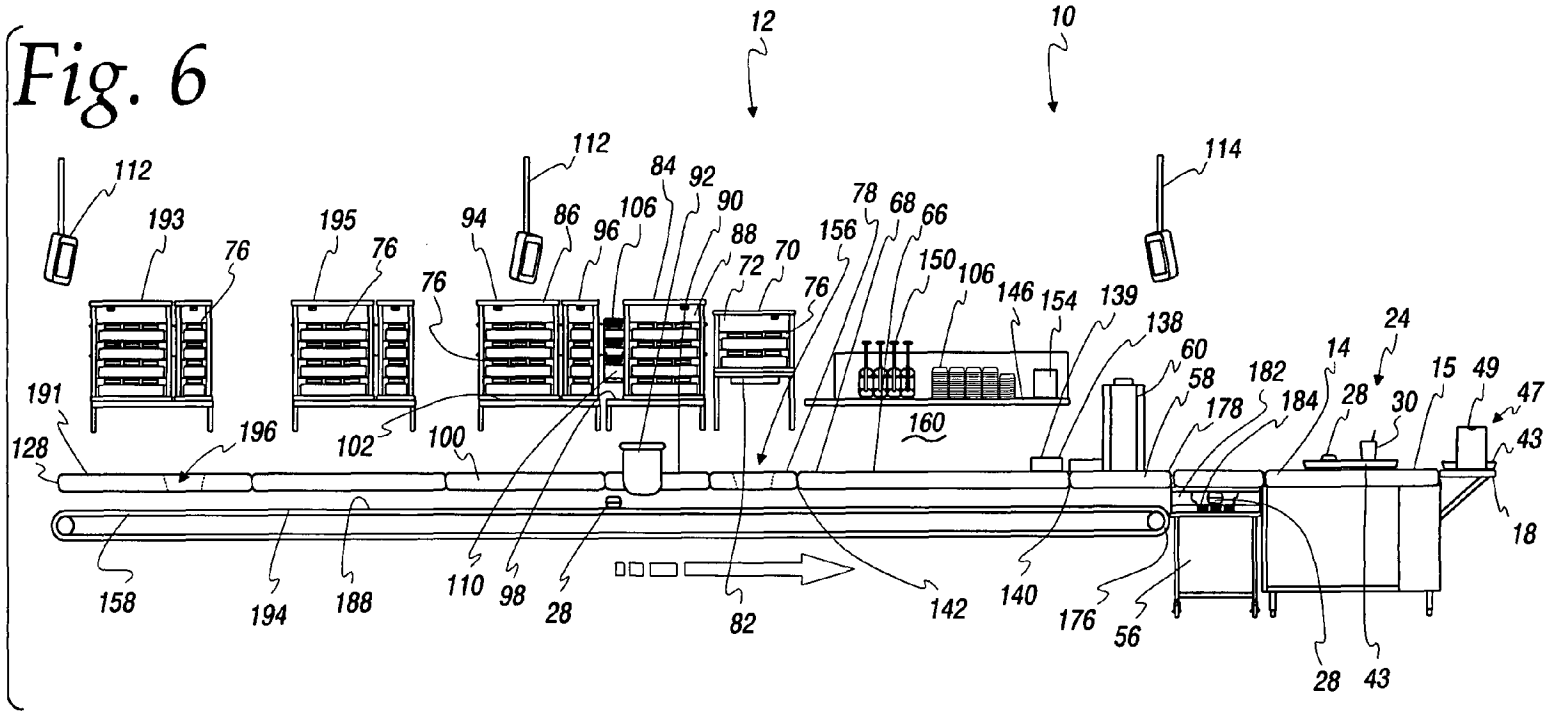
FIG. 6 is a fragmentary schematic side view of the second embodiment in accordance with the invention illustrating an extended conveyor with a second food drop off point.

In the exemplary embodiment shown in FIGS. 2, 3 and 6, conveyor 16 not only extends along the entire length of preparation surface 68, but also extends outward from both the upstream side 162 and the downstream side 164 of food item assembly and packaging module 66. Thus, the upstream portion 168 of conveyor 16 extends into the adjacent secondary module 70. Conveyor 16 is positioned below work surface 78 with its upstream end 170 of conveyor 16 within secondary module 70. Work surface 78 in module 70 is preferably located at the same height as preparation surface 68 to provide a continuous surface with preparation surface 68. Work surface 78 includes conveyor access opening 156 for providing a food drop-off point for sandwiches prepared at food item assembly and packaging module 66, as well as those prepared at other locations along assembly line 12, such as secondary modules 70, 84 and 86. As best seen in FIG. 5, conveyor access opening 156 is preferably located along the central longitudinal axis of work surface 78 so as to be within the convenient reach of food item assembly worker 134, whether standing in aisle 40 or in aisle 64. Also, conveyor access opening 156 is sized so as to easily accommodate the largest size of food item packages used, but not so large as to take up excessive space on work surface 78. While preferably conveyor access opening 156 is an aperture through work surface 78, conveyor access opening 156 may be provided by other arrangements. For example, a conveyor access may be provided by a gap between modules and/or their work surfaces, such as food item assembly and packaging module 66 and secondary module 70, and/or their respective work surfaces 68 and 78. Conveyor access opening 156 may also be provided as an opening through a vertical side of a module along aisles 40 and/or 64. Additionally, for example, conveyor accessing opening 156 may be provided as generally "U" shaped cut outs in a work surface, such as work surface 78, appearing adjacent each of aisles 40, 64.

Conveyor 16 may optionally be set to run continuously during peak food item preparation periods, or alternatively have a worker initiated start and stop control. Conveyor 16 may also include sensing means to automatically turn on conveyor 16 when a packaged food item is placed on conveyor belt 158, and automatically turn off conveyor 16 at a desired time, such as when all packaged food items placed on conveyor belt 158 have been transported off conveyor belt 158.

Conveyor 16 is also positioned underneath work surface 78 of module 70 so as to avoid interference with the work space 174 above work surface 78. The downstream portion 176 of conveyor 16 may extend into the upstream steamer/toaster module 58 where steamer/toaster devices 60 are positioned for convenient access above conveyor 16. The downstream end 176 of conveyor belt 158 preferably extends at least to the downstream side 178 of steamer/toaster module 58. This allows packaged food items 28 conveyed on belt 158 to reach the packaged food item staging module 56 by underneath conveyance through module 58. As shown in FIG. 2, packaged food item staging module 56 has a receptacle 182 having a receptacle surface 184 for receiving packaged food items 28 as they exit from conveyor belt 158. In FIGS. 3, 4, 6 and 7, a partially cut away view of receptacle 182 is provided to show packaged food item 28 held in receptacle 182. Preferably, receptacle surface 184 is at about the same height as the top surface 188 of conveyor belt 158, and may have the same or lesser width than that of belt 158. This allows upstream packages 28 exiting from belt 158 to push downstream packages already on receptacle surface 184 to a position further downstream toward meal order assembly module 14. This not only prevents packages 28 from being backed up on conveyor belt 158, but preserves a first-in, first-out order for packaged food items 28.

Any other suitable arrangement for staging packaged food items known in the art may be used. For example, a bin (not shown) may be placed at downstream end 176 to provide a receptacle into which exiting food item packages 28 may drop. The bin can be positioned at packaged food item staging module 56. Alternatively, the bin may be attached to steamer/toaster module 58, or to food item assembly module 66 so as to thereby eliminate the need for a separate packaged food item staging module 56.

The use of assembly line 12 of the present invention substantially increases work efficiency. With a typical prior art quick-service restaurant layout and assembly line 12, a typical worker will on the average, be required to travel a distance of about 20 feet for each food item assembled and packaged. With assembly line 12 of the present invention, the average distance traveled per worker to assemble and package a food item is reduced to about 16 feet per food item. This substantial 25% reduction of worker travel distances provides numerous benefits including increased labor efficiencies, increased hourly production rates of sandwiches and other food items, potential reduction of the staff size required to meet food item output demands during peak ordering periods, and/or reduction in worker fatigue.

Assembly line 12 also reduces interference between workers 134 as they move about since food items may be prepared at spaced apart locations and regions along assembly line 12 and kitchen layout 10. Also inventory, supplies, equipment, and other food item components may be accessed with minimal distance traveled and with minimal crossing of the paths of workers 134. Also, workers' paths of travel are not routinely crossed during constant back and forth movement to and from meal order assembly module 14 to deliver packaged food items. Instead packaged food items are deposited on conveyor 16 from a proximate food drop-off location provided at conveyor access opening 156. Moreover, conveyor access opening 156 is generally centrally located along the length of the portion of the line provided for assembling and packaging sandwiches, and generally centrally located relative to aisles 40 and 64 to allow working from both sides of assembly line 12. Such arrangements for assembly line 12 not only eliminates or reduces the crossing paths of quickly moving workers, but also increases the safety of the QRS environment.

Moreover, assembly line 12 itself also integrates well within kitchen layout 10. Inventory, storage, cooking equipment and other necessary equipment, and food product components that are incorporated into the food item and packaging for food items, are either included within assembly line 12 or located nearby. Assembly line 12 is also relatively compact and allows for relatively easy expansion to increase food item output, or to accommodate preparation thereon of new food items added to the menu. Such expansion can be accomplished at the upstream end 128 of assembly line 12 leaving its downstream configuration intact, and without expensive changes or relocations of other areas of kitchen layout 10, such as the customer counter area 48, drink station 32, French fry station 36, drive-thru delivery area 50, cooking equipment, increasing aisle width, and the like.

Also, assembly line 12 can be positioned in the restaurant so that only certain operations taking place on assembly line 12 appear in the prominent view of the customers placing and awaiting food item order delivery at the customer point-of-sale food delivery location, such as POS registers 46 at counter 48. Those activities that are in the view of such customers include bun conditioning at steamer/toaster module 58 and optionally also the bun conditioning activity taking place at steamer device 138. The activities at meal order assembly module 14 may also be in view of such customers and optionally a view of the food item assembly and packaging activities taking place at food item assembly and packaging module 66. Preferably, the cooked food storage, such as staging in cooked food storage device 72 and other UHC cabinets for unpackaged cooked food storage, and cooked food storage at hot water food bath 92 is fully screened from prominent view of customers at point-of-sale food delivery locations. This shows customers that the customers' orders including food items are being prepared just before delivery to the customers. Cooked food storage in other locations of kitchen layout 10 that are off-line of assembly line 12, with the possible exception of French fry station 36, are also screened from the prominent view of customers at the point-of-sale delivery location. Such screening from the prominent view of customers awaiting delivery, of course, also takes place at the point-of-sale of drive-thru delivery area 50.

A second embodiment of food item assembly line 12 is shown in FIG. 6. In this embodiment food item assembly line 12 has a conveyor 194 that extends further upstream than in the first embodiment of the invention. A second packaged food item drop-off location is provided by a conveyor access opening 196 that is located upstream from the drop-off location provided by conveyor access opening 156. As shown in FIG. 6, conveyor access opening 196 is located in work area 191 of secondary module 193 that is adjacent to additional secondary module 195. Food item assembly worker 134 assembling a sandwich at secondary module 193 may deposit a packaged sandwich at second conveyor access opening 196. Thus, food item assembly worker 134 need not take time away from food item assembly and/or packaging duties to walk to conveyor drop off 156 at upstream module 66. This eliminated trip is quite advantageous in peak periods of receiving a high level of food item orders. The second food drop-off location provided by conveyor access opening 196 may also be used by a food item assembly worker 134 who has packaged a food item at secondary modules 195 or 86, the latter especially useful in instances when access to drop off at conveyor access opening 156 is hindered by the presence of another worker temporarily standing at conveyor access opening 156.

Figure 7:
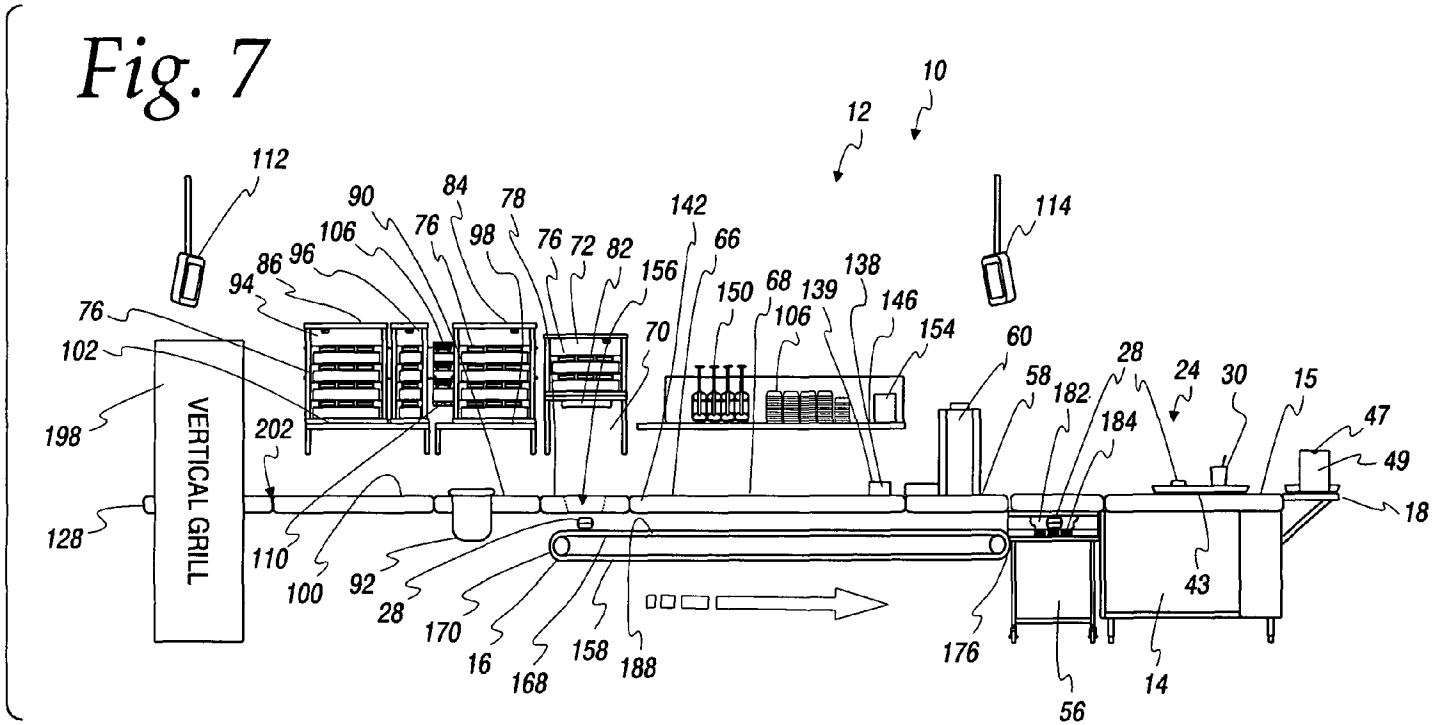
FIG. 7 is a fragmentary schematic side view of another embodiment in accordance with the invention illustrating a vertical grill included in a system for assembling and packaging food items.

FIG. 7 illustrates a modification or alternative configuration of assembly line 12 that includes a vertical grill 198 that may be used for cooking food product such as hamburger patties. An example of such vertical grill cooking equipment is disclosed in U.S. Pat. No. 7,067,769, issued Jun. 27, 2006, the entire disclosure of which is hereby incorporated by reference. Vertical grill 198 is added to the upstream side 202 of the preparation core of the system that includes conveyor 16, food item assembly and packaging module 66 and meal order assembly module 14, and typically also includes steamer/toaster module 58, packaged food item staging module 56, and one or more secondary modules providing additional work area for assembling and/or packaging food items, such as secondary modules 70, 84 and 86. The vertical travel path that hamburger patties travel through vertical grill 198 during grilling reduces the amount of space that vertical grill 198 takes up along assembly line 12. It also provides a supply of cooked food filling such as hamburger patties within assembly line 12 further reducing worker travel distances for making a food item such as, for example, a hamburger sandwich. It also provides a further example of the flexibility of assembly line 12 to be easily reconfigured to adapt to changes in technology providing new equipment for preparing food items without costly changes to the general layout of restaurant layout 10.

Other possible modifications of assembly line 12 include utilizing two or more conveyors in series to extend the effective length of the conveyor 16. For example, an upstream second conveyor (not shown) may be used to service modules 84, 86, and conveyor 16 used to service downstream modules 66, 70. In this arrangement, packaged food items placed on the upstream conveyor are conveyed downstream to upstream end 170 of conveyor 16 and caused to fall or slide from the upstream conveyor to conveyor 16 for transport to meal order assembly module 14. Also, assembly line 12 can be modified so that each module for assembling and/or packaging food items has its own conveyor access opening providing a drop off location at each of such modules. Also, while the invention has been described in regard to manual food preparation, assembly and packaging, one or more of such manually performed functions may be accomplished automatically by equipment designed for such purposes without departing from the scope or spirit of the invention.

Figure 8:
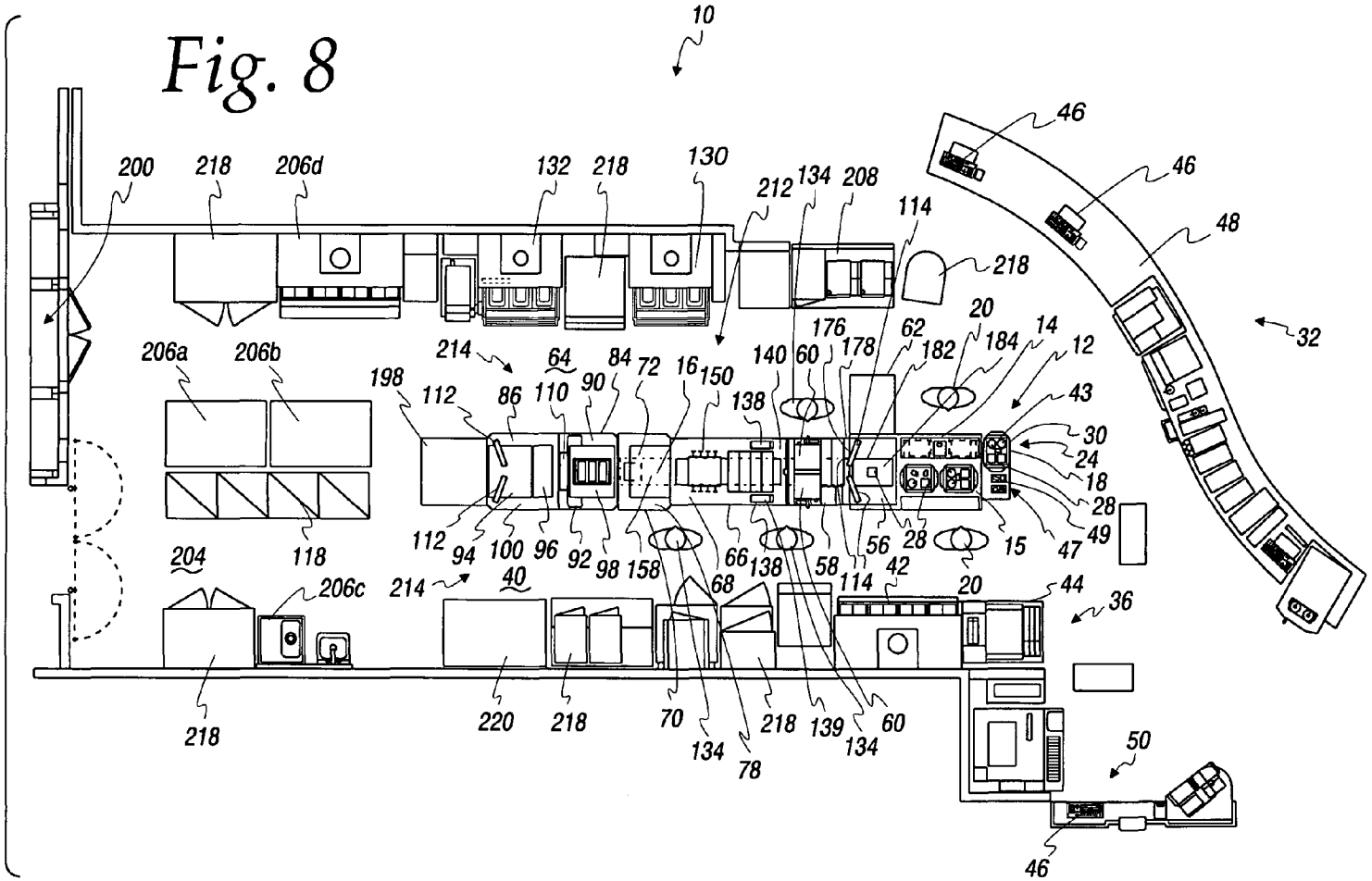
FIG. 8 is a schematic view of the restaurant system and layout in accordance with the present invention illustrating additional components of the restaurant system.

FIG. 8 shows restaurant layout 10 that includes an assembly line 12 that includes vertical grill 198. It also shows restaurant layout 10 with upstream region 204 which includes inventory storage area 200 for various food item inventory. Upstream region 204 provides space that is available for future expansion of the assembly line 12, for various food item cooking, assembly and/or packaging stations 206*a-d*. One or more of additional stations 206*a-d* may be incorporated in-line within assembly line 12, or as illustrated, be positioned off-line of assembly line 12. Food items prepared at an off-line module, such as a salad prepared at station 206*c* can be dropped off at conveyor access opening 156 or a more upstream located additional food drop-off location such as conveyor access opening 196 shown in the embodiment of FIG. 6. Once placed on conveyor 16 the packaged food item is automatically conveyed to meal order assembly module 14, thus reducing worker travel distance and preventing bottlenecks at module 14. As discussed previously, in order to prevent bottlenecks and provide an orderly flow of food items into food order assembly module 14, food items prepared at a more downstream location can also be conveyed to food order assembly module 14, such as a noodle food item prepared at noodle preparation station 208.

FIG. 8 also shows regions of the kitchen layout that localizes activities into areas where all or many of the functions are performed for preparing a type of food item, or in a more general sense preparing food items of a particular menu category. For example, restaurant layout 10 may include a main or regular menu region 212 (shown also in FIG. 1 at a different location), a breakfast menu region 214, and other regions based on other menus such as a brunch menu. Located within such regions, or within relative proximity thereto, are the various cooking, cooked food storage equipment, other storage such as for packaging and other items associated with the preparation of a food item, or multiple food items included in a menu category. Cooling equipment 218 such as freezers and refrigerators and additional cooked food storage devices 124 may also be located in each or most of the regions to further localize activities associated with food item preparation taking place in a particular region. Certain regions may have other specialized equipment located therein such as toaster 220 for toasting used in preparing toasted items for the breakfast menu. Food items prepared, assembled and packaged in the localized menu regions with a reduced average distance for the paths taken by workers accomplish such tasks. Once packaged, a food item is then conveyed by conveyor 16 to the meal order assembly module 14 further conserving worker travel distances. The localized regions also are advantageous for restaurants having menus that change through the day. For example, breakfast region 214, though relatively remote from meal order assembly module 14 when compared to regular menu region 212, is still closely linked to module 14 by the use of conveyor 16 to thereby provide the desired labor efficiencies.

While the invention has been described with respect to certain preferred embodiments, it is to be understood that the invention is capable of numerous changes, modifications and rearrangements without departing from the scope or spirit of the invention as defined in the claims.

What is claimed is:

1. A system for making an assembled food item comprising;

a food item assembly and packaging station comprising at least a first movable module having a first work area for assembling a food item and packaging an assembled food item;

a meal order assembly station remote from the food item assembly and packaging station comprising at least a second movable module having a second work area for assembling a meal order that includes at least one packaged food item packaged on the first work area;

a conveyor for conveying the packaged food item from the first movable module toward the second movable module, the conveyor integral with one of the first or second movable modules, so that when the first movable module is positioned relative to the second movable module to form an assembly line for assembling and packaging food items and meal orders, the conveyor is thereby moved into a position for conveying food items packaged at the first work area and the conveyor extends from a location proximate the first work area to a location proximate the second work area for conveying a packaged food item from a location proximate the first work area to a location proximate the second work area toward the meal order assembly station, a conveyor access proximate the first work area for providing worker access to the conveyor to permit a worker at the first work area to manually deposit the assembled and packaged food item at the conveyor access onto the conveyor for conveying the packaged food item beneath the first work area to the location proximate the meal order assembly station.

2. The system of claim 1 wherein the conveyor is positioned beneath the first work area and the first work area includes a first work surface and the conveyor access comprises an opening in the first work area, and positioning the first and second movable modules causes the conveyor to be positioned along a line along which the packaged food item is conveyed from the first work area to the second work area.

3. The system of claim 2 wherein the first work area has a first side and a second side each side providing a worker access to the first work area and the conveyor access opening is positioned to be readily accessible to a worker positioned adjacent either of the first and second sides of the first work area and the first work area includes a work surface, the conveyor access comprising an opening in the work surface whereby the food item assembled and packaged on the first work area can be placed through the opening in the work surface and deposited on the conveyor for conveyance underneath the first work area toward the second work area.

4. The system of claim 3 further comprising the first work area comprises the first movable module and a third movable module, the third movable module being positioned upstream from the first movable module and the third movable module includes a secondary work station positioned proximate to the food item assembly and packaging station, the secondary work station adapted for assembling and packaging food items of a different type than those packaged at the food item assembly and packaging station, and the first movable module has a downstream side and an upstream side, the upstream side of the first module being positioned proximate to the third movable module and the downstream side of the first movable module being positioned proximate to the second movable module, and the conveyor is mounted to the first movable module and extends upstream from the upstream side of the first movable module so that when the first movable module, the second movable module and the third movable module are moved to form the assembly line, the conveyor extends past the upstream side of the first movable module to a location proximate the third movable module so that food items assembled and packaged at the third movable module may be placed on the conveyor through the access opening and conveyed in a downstream direction from the third movable module, underneath the first work area of the first movable module and past the downstream side of the first movable module toward the second movable module.

5. The system of claim 4 further comprising the third movable module providing a secondary work station for assembling and packaging food items and the third movable module includes the conveyor access opening.

6. The system of claim 5 further comprising at least one storage surface above and proximate to the first work area for storing food items manually included in a food item assembled at the first work area, and the third movable module has a downstream side positioned adjacent the upstream side of the first movable module to thereby position the conveyor to extend upstream of the downstream side of the first movable module and into the third movable module, and the conveyor has a first end positioned adjacent the access opening in the third movable module.

7. The system of claim 1 further comprising at least one storage surface at the food item assembly and packaging station for storage of packaging for packaging a food item at the first work area.

8. The system of claim 1 further comprising at least one cooked food storage device proximate to the first work area for staging a cooked food item filling that is included in a food item assembled at the first work area.

9. The system of claim 8 further comprising:

at least one bun conditioning system positioned proximate to the first work area for conditioning a bun included in a food item assembled at the first work area; and a customer point-of-sale food delivery location wherein the bun conditioning system is prominently visible to a customer located at the customer point-of-sale food delivery location and wherein the cooked food storage is not prominently visible to a customer at the customer point-of-sale food delivery location.

10. The system of claim 1 further comprising the food item assembly and packaging station including a third movable module having a downstream side and an upstream side, the third movable module including at least one bun conditioning device positioned proximate to the first work area for conditioning a bun included in a food item assembled at the first work area, the third movable module positioned downstream of the first movable module and upstream of the second movable module when the modules are positioned to form the assembly line, the conveyor mounted to the first movable module and extending past the downstream side of the first movable module, the conveyor extending below the bun conditioning device and through the third movable module and downstream past the upstream side of the third movable module, whereby packaged food items can be conveyed downstream from the food item assembly and packaging station, through the first movable module, through the third movable module and downstream past the third movable module toward the second movable module.

11. The system of claim 10 wherein the bun conditioning device is a bun steamer that steams a bun and is positioned at the food item assembly and packaging station.

12. The system of claim 10 further comprising a fourth movable module positioned in the assembly line between the third movable module and the second movable module, the fourth movable module having a downstream side and an upstream side, the fourth movable module including a heating means for maintaining packaged food items at an elevated temperature and a work surface having an access opening for removing therethrough the packaged food items held at the fourth movable module, the upstream side of the fourth movable module positioned adjacent to the downstream side of the third movable module whereby packaged food items are conveyed through the third movable module to a position at the fourth movable module for holding the packaged food items, whereby packaged food items at an elevated temperature may be manually removed through the access opening for including in an assembled and packaged meal order.

13. The system of claim 1 further comprising a plurality of secondary work stations each having at least one work area at which assembling or packaging a food item takes place.

14. The system of claim 13 further comprising at least one of the secondary work stations includes a cooked food storage device for staging a cooked food item filling included in a food item assembled on the assembly line, and at least one of the secondary work stations includes a storage surface for packaging used for packaging a food item assembled at a secondary work station.

15. The system of claim 14 wherein the conveyor extends underneath the first work area and at least one work area for a secondary work station.

16. The system of claim 15 wherein the conveyor extends underneath at least two of said work stations.

17. The system of claim 16 wherein each of the stations is modular and repositionable within the assembly line to allow reconfiguration of the order of the stations within the apparatus.

* * * * *